US009065176B2

(12) United States Patent
Wang

(10) Patent No.: US 9,065,176 B2
(45) Date of Patent: Jun. 23, 2015

(54) ULTRA-WIDEBAND CONFORMAL LOW-PROFILE FOUR-ARM UNIDIRECTIONAL TRAVELING-WAVE ANTENNA WITH A SIMPLE FEED

(75) Inventor: Johnson J. H. Wang, Marietta, GA (US)

(73) Assignee: WANG-ELECTRO-OPTO CORPORATION, Marietta, GA (US)

( * ) Notice: Subject to any disclaimer, the term of this patent is extended or adjusted under 35 U.S.C. 154(b) by 162 days.

(21) Appl. No.: 13/398,477

(22) Filed: Feb. 16, 2012

(65) Prior Publication Data

US 2012/0249385 A1 Oct. 4, 2012

Related U.S. Application Data

(60) Provisional application No. 61/469,409, filed on Mar. 30, 2011.

(51) Int. Cl.

| | |
|---|---|
| ***H01Q 11/02*** | (2006.01) |
| ***H01Q 1/36*** | (2006.01) |
| ***H01Q 1/38*** | (2006.01) |
| ***H01P 1/16*** | (2006.01) |
| ***H01Q 9/27*** | (2006.01) |
| ***H01Q 11/10*** | (2006.01) |

(52) U.S. Cl.

CPC ..... *H01Q 9/27* (2013.01); *H01Q 11/105* (2013.01)

(58) Field of Classification Search

CPC ..... H01Q 11/10; H01Q 11/105; H01Q 11/02; H01Q 10/27; H01Q 9/27

USPC ..... 343/731, 895

See application file for complete search history.

(56) References Cited

U.S. PATENT DOCUMENTS

| | | | | |
|---|---|---|---|---|
| 3,555,554 | A * | 1/1971 | Kuo | 343/895 |
| 3,624,658 | A * | 11/1971 | Voronoff | 343/805 |
| 5,313,216 | A | 5/1994 | Wang et al. | |
| 5,453,752 | A | 9/1995 | Wang et al. | |

(Continued)

FOREIGN PATENT DOCUMENTS

| | | | |
|---|---|---|---|
| CN | 1185761 | C | 1/2005 |

OTHER PUBLICATIONS

Feng et al. "A Wideband SMM Antenna with Gap and Dielectric Loadings" 2011 Fourth International Conference on Intelligent Computation Technology and Automation. pp. 393-396. Date of Conference: Mar. 28-29, 2011.*

(Continued)

*Primary Examiner* — Dameon E Levi
*Assistant Examiner* — Ricardo Magallanes
(74) *Attorney, Agent, or Firm* — Thomas | Horstemeyer, LLP

(57) ABSTRACT

The invention is a class of planar unidirectional traveling-wave (TW) antenna comprising a planar four-arm TW radiator ensemble, such as a 4-arm spiral, which is fed medially with a twin-lead feed connected with only a pair of opposite arms of the TW radiator, with the other two arms parasitically excited. The use of a mode suppressor enhances the purity of single-mode TW propagation and radiation. The twin-lead feed is connected with the balanced side of a balun, and is impedance matched with the TW radiator on one side and the balun on the other side. This simple feed structure using a single balun is generally smaller and much simpler, and thus much less costly than the conventional feed for a 4-arm spiral, which is a complex one-to-four power divider that contains hybrids, power dividers, couplers, matrices, etc.

10 Claims, 7 Drawing Sheets

(56) References Cited

U.S. PATENT DOCUMENTS

| | | | | |
|---|---|---|---|---|
| 5,508,710 | A | 4/1996 | Wang | |
| 5,589,842 | A | 12/1996 | Wang | |
| 5,621,422 | A | 4/1997 | Wang | |
| 5,936,595 | A | 8/1999 | Wang | |
| 6,137,453 | A | 10/2000 | Wang et al. | |
| 7,545,335 | B1 | 6/2009 | Wang | |
| 2010/0007555 | A1* | 1/2010 | Ezal et al. | 342/357.12 |

OTHER PUBLICATIONS

Wang, J. J. H., "The Spiral as a Traveling Wave Structure for Broadband Antenna Applications," Electromagnetics, pp. 20-40, Jul.-Aug. 2000.

Wang, J. J. H. and Tripp, V. K., "Design of Multioctave Spiral-Mode Microstrip Antennas," IEEE Trans. Ant. Prop, Mar. 1991.

Wang, J. J. H. and D. J. Triplett, "High-Performance Universal GNSS Antenna Based on GNSS Antenna Technology," IEEE 2007 International Symposium on Microwave, Antenna, Propagation and EMC Technologies for Wireless Communications, Hangzhou, China, Aug. 14-17, 2007.

Wang, J. J. H., "Beam Switching and Steering of Spiral-Mode Microstrip Antennas", Proceedings of the 1992 International Symposium on Antennas and Propagation held Sep. 22-25, 1992 in Sapparo, Japan, vol. 1, Sep. 22, 1992.

Sam C. Kuo, "Planar spiral, a microstrip antenna?", Proceedings of the 1992 Antenna Applications Symposium, Paul Mayes, et al, U.S Air Force Rome Laboratory Report RL-TR-93-119, vol. II, pp. 363-394, Jun. 1993. (http://www.dtic.mil/dtic/tr/fulltext/V2/a266916.pdf).

Chinese Office Action in co-pending, releated Chinese Applicaion No. 20120079749.0, mailed Sep. 29, 2014.

* cited by examiner

ULTRA-WIDEBAND CONFORMAL LOW-PROFILE FOUR-ARM UNIDIRECTIONAL TRAVELING-WAVE ANTENNA WITH A SIMPLE FEED

CROSS-REFERENCE TO RELATED APPLICATION

This application claims priority to U.S. provisional application entitled, "Ultra-Wide Conformal Low-Profile Four-Arm Unidirectional Traveling-Wave Antenna with a Simple Feed," having Ser. No. 61/469,409, filed Mar. 30, 2011, which is entirely incorporated herein by reference.

TECHNICAL FIELD

The present invention is generally related to radio-frequency antennas and, more particularly, ultra-wideband low-profile multi-arm unidirectional traveling-wave (TW) antennas for conformal mounting on platforms.

BACKGROUND

The traveling-wave (TW) antenna is a class of ultra-wideband platform-compatible low-profile antennas, including the spiral-mode microstrip (SMM) antennas and miniaturized slow-wave (SW) antenna, among others. The SMM antenna was discussed in publications (Wang, J. J. H. and V. K. Tripp, "Design of Multioctave Spiral-Mode Microstrip Antennas," *IEEE Trans. Ant. Prop.*, March 1991; and Wang, J. J. H., "The Spiral as a Traveling Wave Structure for Broadband Antenna Applications," *Electromagnetics,* 20-40, July-August 2000) and U.S. Pat. No. 5,313,216, issued in 1994; U.S. Pat. No. 5,453,752, issued in 1995; U.S. Pat. No. 5,589,842, issued in 1996; U.S. Pat. No. 5,621,422, issued in 1997; U.S. Pat. No. 7,545,335 B1, issued in 2009) which are incorporated herein by reference. The SW antenna is a subset of the TW antenna with its size miniaturized by the SW technique (U.S. Pat. No. 6,137,453 issued in 2000, which is incorporated herein by reference). These thin planar antennas generally consist of an ultra-wideband planar radiator in the form of a multi-arm spiral, sinuous structure, or other frequency-independent geometries, among which the most widely used is the two-arm spiral antenna, having a unidirectional radiation pattern. The planar multi-arm spirals generally take an Archimedean or equiangular form, as widely discussed in the literature and in particular in the paper by Wang and Tripp (1991) cited above. (pp. 333-334).

The unidirectional radiation pattern is due to mode-1 of TW modes; presence of other TW modes, 0, 2, 3, 4, etc. would distort the radiation pattern. Because of the lack of full symmetry, the commonly used two-arm unidirectional spiral radiator cannot achieve a high degree of mode purity, thus is limited in radiation pattern performance. For applications requiring high-quality radiation patterns, such as the GNSS (Global Navigation Satellite System) receive antenna or elements in planar phased arrays, a four-arm spiral radiator in the SMM antenna was more desirable (e.g., Wang and Triplett, "High-Performance Universal GNSS Antenna Based on GNSS Antenna Technology," *IEEE* 2007 *International Symposium on Microwave, Antenna, Propagation and EMC Technologies for Wireless Communications*, Hangzhou, China, 14-17 Aug. 2007 which is incorporated herein by reference).

Unfortunately, to realize the potential of the four-arm SMM antennas, or the cavity-loaded spiral antenna, a high-quality four-terminal feed is needed to provide equal amplitude and relative phases of 0°, 90°, 180°, 270°, respectively.

Such a complex feed, which uses a number of hybrids, power dividers, couplers, matrices, etc. leads to enormous escalation in cost and reduction in gain/efficiency as compared with the two-arm version. Additionally, the complexity and size of such a four-arm feed pose a serious difficulty in its physical implementation in GNSS and array antennas.

Disclosed are various embodiments for a method in which these 4-arm unidirectional TW antennas are fed with a mechanism using a single balun that is generally smaller, much simpler, and thus much less costly, feed. The geometric symmetry of the new approach can also lead to a more accurate feed and thus improve the high performance of the four-arm version further above the two-arm version, at a low cost.

DETAILED DESCRIPTION OF THE INVENTION DISCLOSURE

Figure 1A:
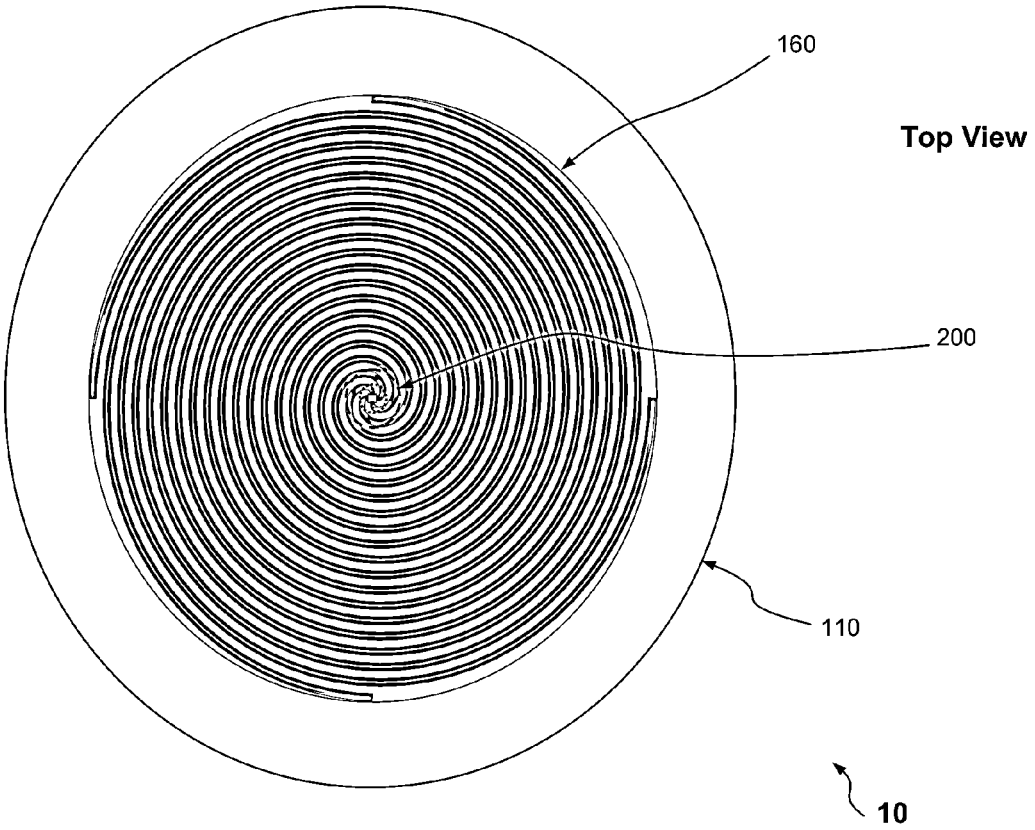
FIG. 1A depicts, in top view, an ultra-wideband low-profile 4-arm unidirectional traveling-wave antenna fed by a simple balun with a mode suppressor.
Figure 1B:
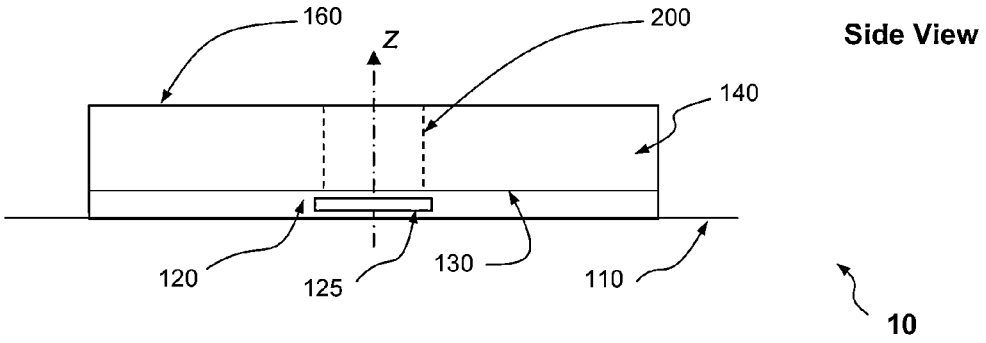
FIG. 1B depicts, in side view, the ultra-wideband low-profile 4-arm unidirectional traveling-wave antenna of FIG. 1A.

FIGS. 1A and 1B depict the top and side views, respectively, of an ultra-wideband low-profile mode-1 4-arm traveling-wave (TW) antenna 10, which is of the shape of a pillbox, preferably circular but can be of other polygonal cylindrical form symmetrical about its center axis z. The antenna 10 is comprised of a planar conducting plane 110, a feed network 120, a planar conducting plane 130, a TW structure 140, and a planar TW radiator ensemble 160, stacked, one on top of the other, sequentially, as well as a feed ensemble 200. The thickness of the antenna 10 is electrically small, generally less than $0.1\lambda_L$, where $\lambda_L$ denotes the free-space wavelength at the lowest frequency of operation. The diameters of the planar TW radiator ensemble 160, the TW structure 140, and the feed network 120 are generally the same and preferably less than 0.4 $\lambda_L$. The diameter of the planar conducting plane 110 must be at least as large as that of the TW structure 140.

Figure 2A:
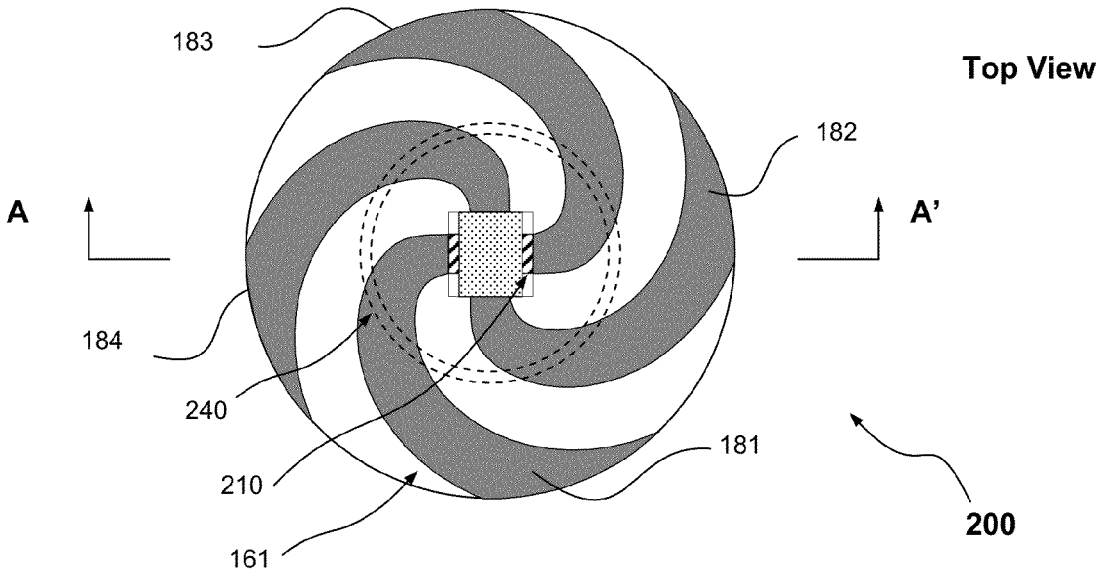
FIG. 2A shows top view of the feed region for the ultra-wideband low-profile 4-arm traveling-wave antenna in FIG. 1A.
Figure 2B:
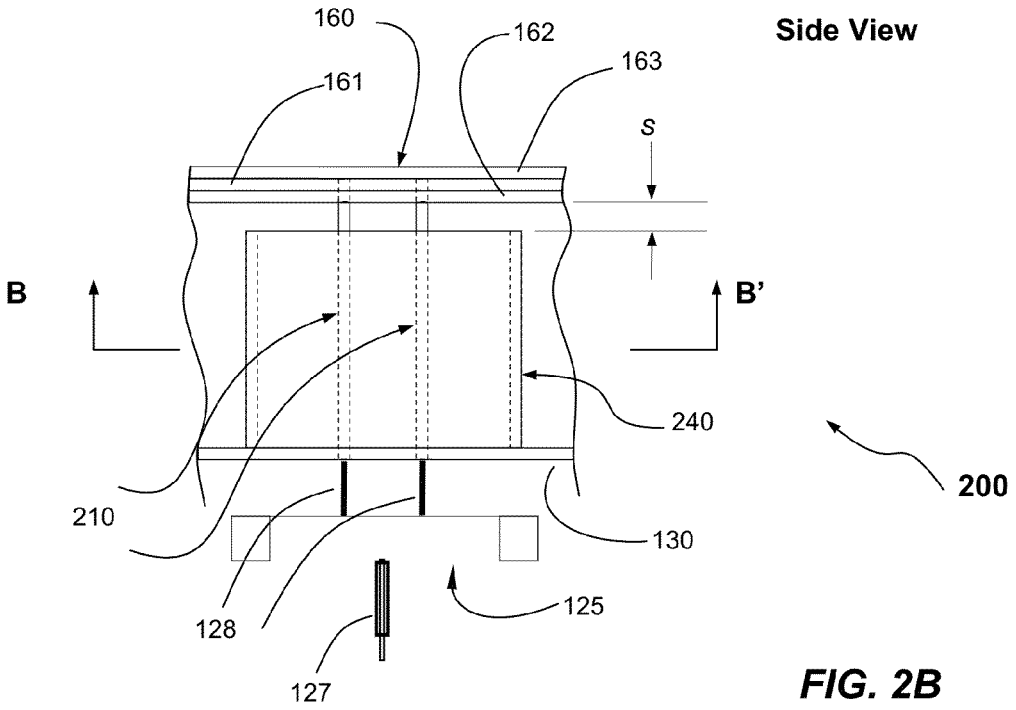
FIG. 2B shows side view of the feed region for the ultra-wideband low-profile 4-arm traveling-wave antenna in FIG. 1A.
Figure 2C:
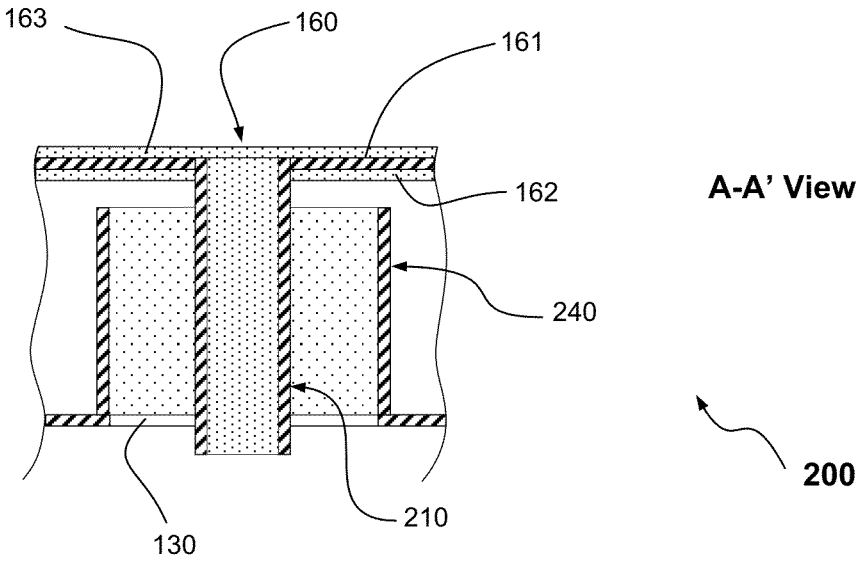
FIG. 2C shows A-A' cross-sectional view of the feed region for the ultra-wideband low-profile 4-arm traveling-wave antenna in FIG. 2A.

The planar TW radiator ensemble 160 consists of three thin layers: the TW radiator 161 in the center layer, the dielectric superstrate 163 and the dielectric substrate 162, as shown in the top, side, and cross-sectional A-A' views in FIGS. 2A, 2B and 2C, respectively, in the central region. The TW radiator 161 is an ultra-wideband planar radiator in the form of a multi-arm spiral, sinuous structure, or other frequency-independent geometries, among which the most widely used is the spiral antenna generally of an Archimedean or equiangular form, as discussed earlier and displayed in FIGS. 1A and 2A. The planar TW radiator ensemble 160 is excited by feed ensemble 200, which is connected with a simple balun 125 contained in the feed network 120. Balun 125 is a passive two-port device used to connect two systems, as depicted in FIG. 2B, where one port of the balun, denoted by 128, is a balanced transmission line (such as the twin-lead or two-wire transmission line) and the other port of the balun, denoted by 127, is an unbalanced transmission line (such as the coaxial cable depicted in FIG. 2B, or a stripline, or a mircrostrip line, etc.). RF signals are, as a rule, transmitted on unbalanced lines, which are generally shielded, to meet regulatory and performance requirements such as efficiency, electromagnetic compatibility (EMC), and electromagnetic interference (EMI), etc. On the other hand, the input arms of the TW radiator ensemble 160 must be excited in a balanced way, with equal amplitudes and 180-degree out of phase. Therefore, the balun used here has its unbalance side 127 connected to the transceiver and its balanced side 128 connected to the TW radiator ensemble 160.

A balun is also required to serve as an impedance transformer between the system on the balanced side 128 and the system on the unbalanced side 127. Without adequate impedance transformation between the balanced and unbalanced sides of the balun, undesired modes will emerge and disrupt the propagating wave, leading to degradation of the antenna efficiency, gain, and radiation patterns whether in a single-mode operation or a multi-mode operation. Note that, for the convenience of illustrating the details of the configuration, we define a small region in antenna 10 that contains the feed ensemble 200 in the center, with their components designated numerically in 200s. The periphery of feed ensemble 200 is somewhat arbitrary, defined for the convenience of illustration, not as a structurally exclusive region. In fact, the drawings in FIGS. 2A, 2B, 2C, and 2D showing the details of the feed ensemble 200 exhibit some structural overlaps with the rest of antenna 10. Practically, the regions inside and outside feed ensemble 200 are expected to be well integrated in manufacturing.

The TW antenna 10 is to be conformally mounted on the surface of a platform, which is generally curvilinear. As a practical matter, the antenna is often placed on a relatively flat area on the platform, and does not have to perfectly conform to the platform surface since the TW antenna has its own conducting ground surface. In practice, the conducting ground surface is generally chosen to be planar or part of a canonical shape, such as a cylinder, sphere, or cone that is easy and inexpensive to fabricate. In any case conducting surfaces 110 and 130, as well as TW structure 140 and TW radiator ensemble 160, share the same canonical shape and are all parallel to one another and symmetrical about the vertical center axis z.

FIG. 2A shows a top view of the TW radiator ensemble 160 in the feed region. As shown in the side view and cross-sectional A-A' view in FIGS. 2B and 2C, respectively, the TW radiator ensemble 160 consists of three thin layers: the TW radiator 161 in the center layer, the dielectric superstrate 163 and the dielectric substrate 162. Note that the drawings in FIGS. 1A and 2A show embodiments in which the thickness of superstrate 163 vanishes and thus the TW radiator 161, a four-arm Archimedean spiral in this case, is visible. The thin dielectric superstrate 163 and dielectric substrate 162 serve primarily to accommodate the printed circuit board fabrication process and provide mechanical and structural support for the TW radiator ensemble 160, but also has electrical effects on the design. Note that the TW radiator 161 in FIG. 1A is Archimedean, yet is transitioned to equiangular FIG. 2A in the central feed region. Note that the diameter of feed ensemble 200 is arbitrarily selected for the convenience of illustration, and there is no structural discontinuity at the circular boundary.

In prior art, the four terminals of the spiral in mode-1 operation, designated as arms 181, 182, 183, and 184, respectively, are fed with excitations of equal amplitude and relative phases of, say, 0°, 90°, 180°, 270°, respectively and consistent with the sense of the polarization of the spiral. In this invention, one pair of opposite terminals 181 and 183 is excited with equal amplitude and relative phases of 0° and 180°, respectively, and the other pair of opposite terminals 182 and 184 is excited parasitically, by the feed ensemble 200, as shown in A-A' cross-sectional view in FIG. 2A. To ensure that the parasitic excitation of terminals 182 and 184, without direct contact with the feed line, is proper, we employ a feed ensemble 200, which comprises a twin-lead feed 210 and a mode suppressor 240.

The twin-lead feed 210 has an impedance around 100 ohms, and is to be fine-tuned to match the impedance of the TW radiator ensemble 160 in the environment of TW structure 140 and mode suppressor 240 over the ultra-wide frequency band of operation. As shown in FIGS. 1B, 2B and 2C, the twin-lead feed 210 extends beyond the conducting ground plane 130 and then connects the two output terminals 128 on the balanced side of a balun 125 positioned in the feed network 120, which is generally a stripline or microstrip printed circuit board enclosed by conducting ground planes 110 and 130 and side conducting walls. Balun 125 can be of any other shape and at other location as long as it is below either ground plane 130 or ground plane 110 (thus always below ground plane 130). A balun is a device that connects an unbalanced transmission line on one side to a balanced transmission line on the other side, and also performs needed impedance matching (transformation) between the two sides. In the present embodiment, the balanced side of the balun (128) is connected to the balanced twin-lead transmission line, and the unbalanced side of the balun (127) is connected with impedance matching to an unbalanced coaxial connector at the end of the feed network for connection with an external transmitter/receiver or other subsystem.

The mode suppressor 240 is a circular conducting tube having a small diameter, generally less than about 0.01 $\lambda_L$, to ensure smooth transition of TW propagation from twin-lead feed 210 and the TW radiator ensemble 160 (FIGS. 1B, 2B and 2C). The top of mode suppressor 240 is spaced at a distance S below the TW radiator ensemble 160 and its bottom joining the conducting ground plane 130. The spacing S is small, less than about 0.01 $\lambda_L$, and is a tradeoff between smooth launching of mode-1 spiral mode in the TW radiator ensemble 160 and the suppression of higher-order modes in the wave propagation between the TW radiator ensemble 160 and the conducting ground plane 130. FIG. 2B further reveals a B-B' cross-sectional view of the feed ensemble 200 showing the twin-lead feed 210 and the mode suppressor 240 in the form of a conducting cylindrical tube.

Figure 2D:
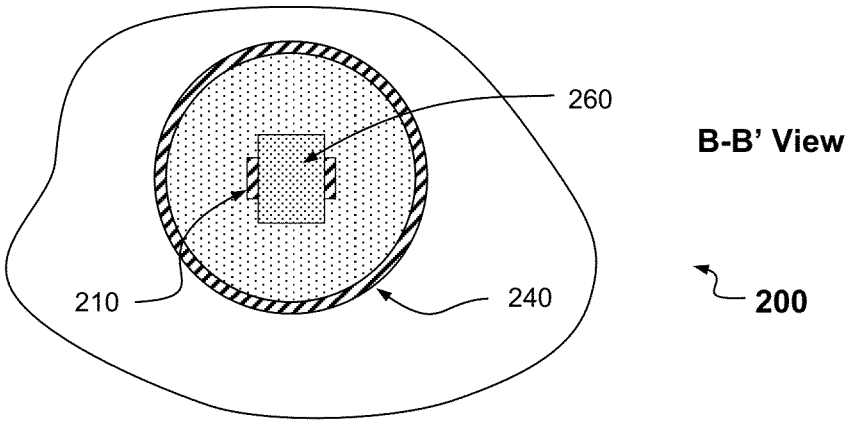
FIG. 2D shows B-B' cross-sectional view of the feed region for the ultra-wideband low-profile 4-arm traveling-wave antenna in FIG. 2B.

As can be seen in FIG. 2D, the twin-lead feed 210 can be fabricated on a double-sided printed circuit board of a low-loss dielectric substrate 260. Between the twin-lead feed 210 and the mode suppressor 240 is filled, in part or in whole, another low-loss dielectric which may or may not be the same as that of the printed circuit board of the twin-lead feed 210. The feed ensemble 200 can be mass produced by planar printed-circuit-board (PCB) fabrication techniques, in which case the twin-lead feed 210 can start with two circular via holes, which are then metal-plated for integration with the TW radiator 161 (FIGS. 2B and 2C) and balun in the feed network 120.

Figure 3A:
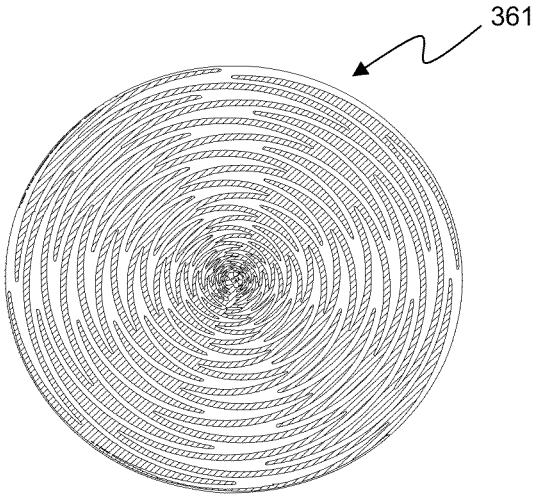
FIG. 3A depicts a planar four-arm sinuous TW radiator.
Figure 3B:
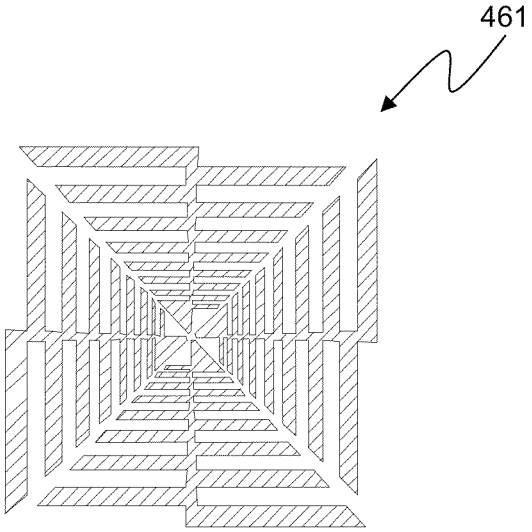
FIG. 3B depicts a planar four-arm log-periodic TW radiator.

The TW radiator 161, which is a four-arm Archimedean spiral as shown in FIG. 1A, is in general a planar multi-arm frequency-independent structure, most of which are of self-complementary geometry. For example, FIG. 3A depicts a planar four-arm sinuous TW radiator 361, and FIG. 3B depicts a planar four-arm log-periodic TW radiator 461. The spiral type radiator has inherently circularly polarization (CP) with a sense of right-hand CP (RHCP) or left-hand CP (LHCP) determined by the spiral windings being counter-clockwise or clockwise for the convention of time-harmonic fields chosen—either $\exp(j\omega t)$ or $\exp(-j\omega t)$.

The sense of the circular polarization of the planar radiators in FIG. 3 is rooted not only in the radiator per se but also in the way the four arms are fed, in the sequence of (0°, 90°, 180°, 270°) or (0°, −90°, −180°, −270°). When a non-spiral is employed as TW radiator 161 (FIGS. 3B and 3C) and fed with the present simple feed, it will radiate in linear polarization, which results from the combination of the RHCP and LHCP, in equal phase and amplitude, inherent in the radiator.

The TW structure 140 can be of a slow-wave (SW) type. The use of an SW structure can lead to reduction of phase velocity characterized by a slow-wave factor (SWF). The SWF is defined as the ratio of the phase velocity $V_s$ of the TW to the speed of light c, given by the relationship $$\mathrm{SWF}=c/V_s=\lambda_o/\lambda_s \tag{1}$$

where c is the speed of light, $\lambda_o$ is the wavelength in free space, and $\lambda_s$ is the wavelength of the slow-wave, at the operating frequency $f_o$. Note that the operating frequency remains the same both in free space and in the slow-wave antenna. The SWF indicates how much the TW antenna is reduced in a relevant linear dimension. For example, an SW antenna with an SWF of 2 means its linear dimension in the plane of SW propagation is reduced to ½ of that of a conventional TW antenna. Note that, for size reduction, it is much more effective to reduce the diameter, rather than the height, since the antenna size is proportional to the square of antenna diameter, but only linearly to the antenna height. Note also that in this disclosure, whenever TW is mentioned, the case of SW is generally included. Many variations and modifications may be made to the above-described embodiments of the invention without departing substantially from the spirit and principles of the invention. All such modifications and variations are intended to be included herein within the scope of the present invention.

Experimental Verification

Experimental verification of the principles of the invention has been carried out satisfactorily. Several breadboard models were designed, fabricated, and tested. Some measured data on one model is displayed here to demonstrate that the principles of this invention are valid, and that the imperfections in the performance are primarily due to the deficiencies of the balun employed.

Figure 4:
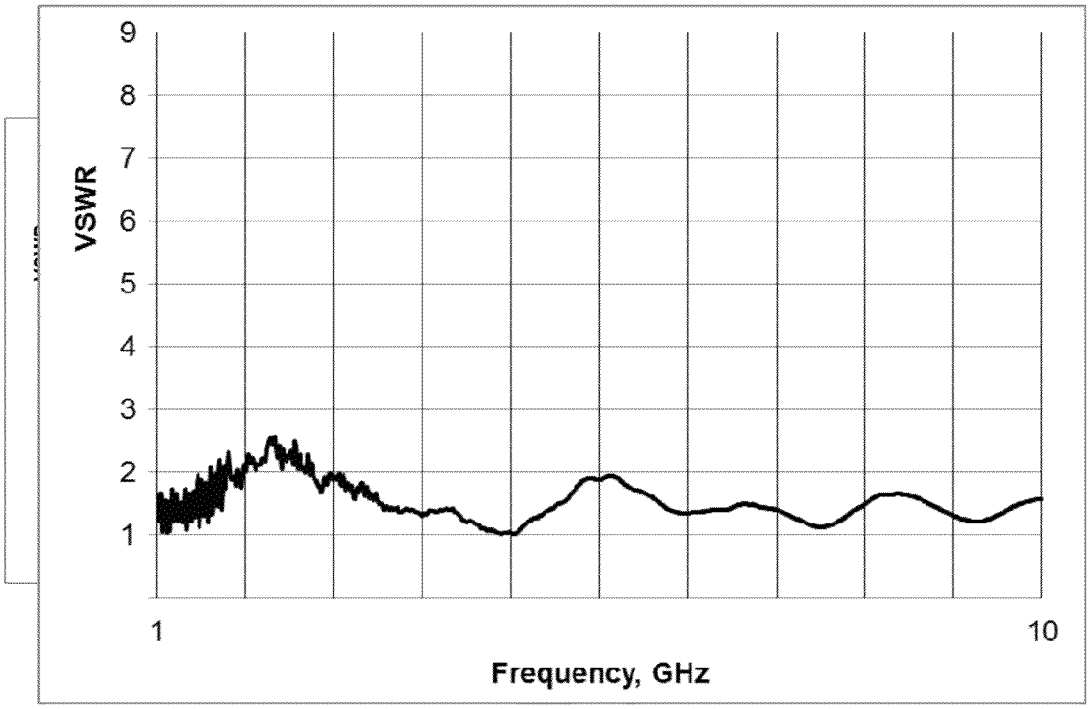
FIG. 4 shows measured VSWR over 1-10 GHz for the unidirectional traveling-wave antenna in FIG. 1A and FIG. 1B.
Figure 5:
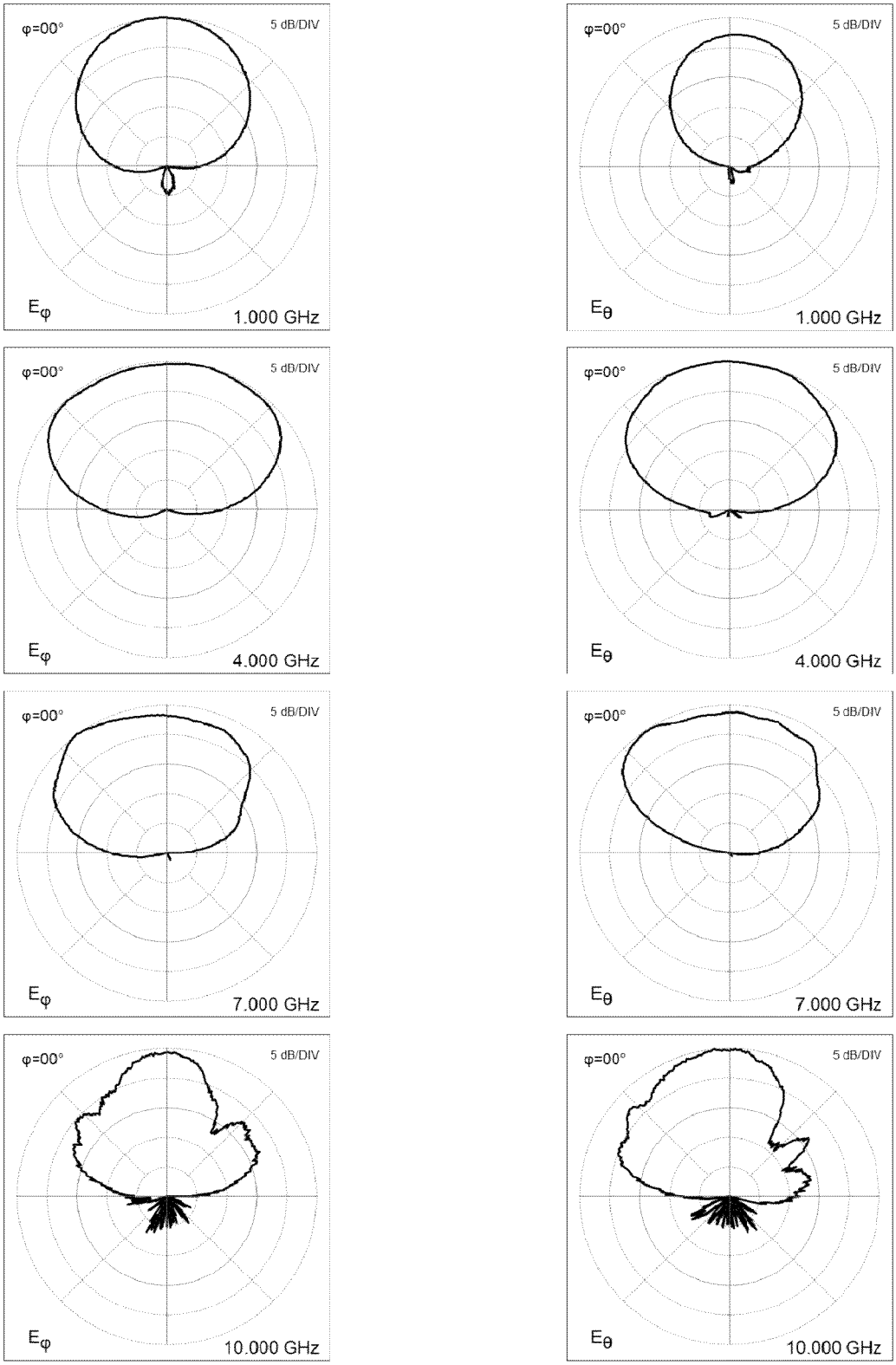
FIG. 5 shows typical measured elevation radiation patterns in two orthogonal linear polarizations over 1-10 GHz for the unidirectional traveling-wave antenna in FIG. 1A and FIG. 1B.
Figure 6:
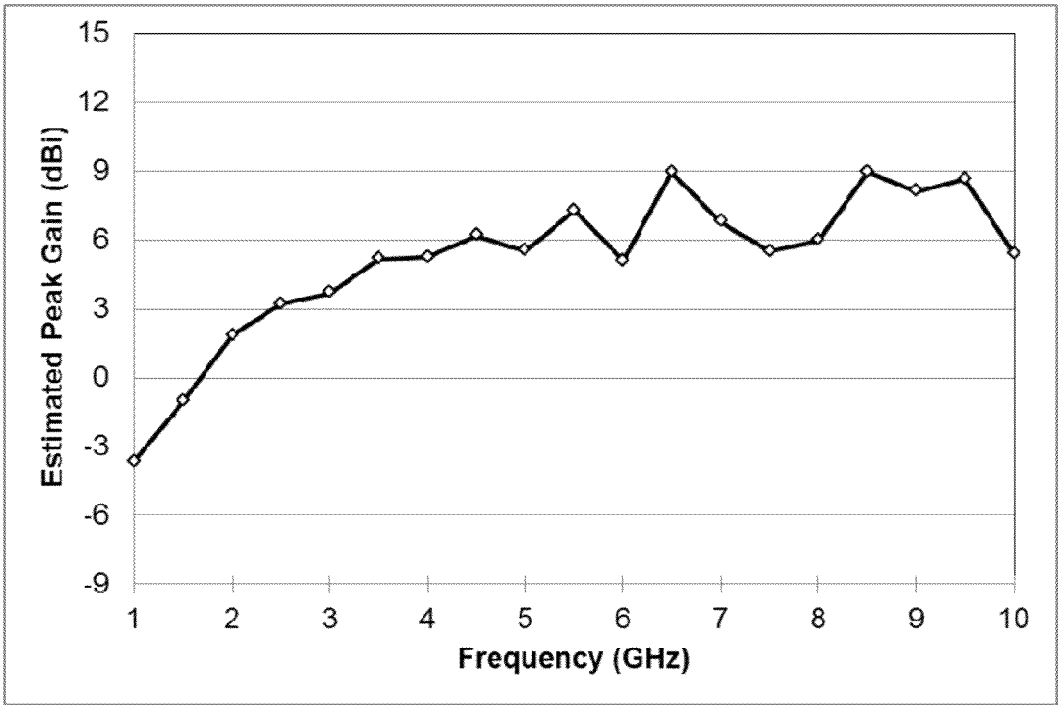
FIG. 6 shows measured antenna gain in dBi over 1-10 GHz for the unidirectional traveling-wave antenna in FIG. 1A and FIG. 1B.

FIG. 4 shows measured VSWR over 1-10 GHz for a breadboard model of the unidirectional traveling-wave antenna in FIG. 1 using a four-arm Archimedean spiral radiator. FIG. 5 shows typical measured elevation radiation patterns in two orthogonal linear polarizations ($E_\theta$ and $E_\phi$) over 1-10 GHz for this antenna. FIG. 6 shows estimated antenna gain in dBi (primarily CP and based on combining measured gain in dBiL and axial ratio for two orthogonal linear polarizations) for this antenna over 1-10 GHz. These data are fairly good for a crude breadboard. Separate tests on the balun alone revealed that amplitude and phase errors in the balun (which is outside the scope of the present invention) are primarily the cause of the imperfections at certain frequencies in the feed output and, consequently, the exhibited performance of the antenna. Later models focused on narrower bandwidths, such as GNSS, for which the component and fabrication tolerances can be more easily met, exhibited greatly improved performance.

The invention claimed is:

1. A unidirectional traveling-wave (TW) antenna comprising:

a vertically stacked structure comprising a conducting ground plane, a feed network, a TW structure, and a planar four-arm TW radiator ensemble which comprises a TW radiator, wherein the vertically stacked structure further comprises a feed ensemble in the center;

the feed network being generally a stripline or microstrip printed circuit enclosed by said conducting ground plane and another parallel conducting ground plane as well as side conducting walls, and comprising a single balun, wherein said balun is positioned below the said conducting ground plane and the balanced side of said balun is connected to a twin-lead feed line in the feed ensemble;

the feed ensemble comprising a twin-lead transmission line and a mode suppressor, which is conducting for the TW waves at the operating frequencies of said TW antenna and wherein the twin-lead transmission line connects a first pair of opposite arms in the medial portion of the four-arm TW radiator ensemble, and a second pair of opposite arms of the TW radiator ensemble being parasitically excited; wherein the mode suppressor comprising a symmetrical conducting tube enclosing the twin-lead transmission line that is connected to the planar TW radiator ensemble;

the unidirectional TW antenna having a thickness, the thickness being less than 0.1 λL, wherein λL denotes the free-space wavelength at the lowest frequency of operation; and wherein the TW structure, the planar TW radiator, the feed ensemble and the TW antenna exhibit a twofold rotational symmetry about the center axis of the antenna.

2. The unidirectional TW antenna as claimed in claim 1, wherein the planar TW radiator in the TW radiator ensemble is a four-arm Archimedean spiral.

3. The unidirectional TW antenna as claimed in claim 1, wherein the planar TW radiator in the TW radiator ensemble is a four-arm sinuous antenna.

4. The unidirectional TW antenna as claimed in claim 1, wherein the planar TW radiator in the TW radiator ensemble is a four-arm log-periodic spiral.

5. The unidirectional TW antenna as claimed in claim 1, wherein the planar TW radiator in the TW radiator ensemble is a four-arm equiangular spiral.

6. The unidirectional TW antenna as claimed in claim 1, wherein the planar TW radiator in the TW radiator ensemble is a planar multi-arm frequency-independent structure.

7. The unidirectional TW antenna as claimed in claim 1, wherein the conducting ground surfaces, the TW structure and the TW radiator ensemble are parallel relative to each other.

8. The unidirectional TW antenna as claimed in claim 1, wherein the conducting ground surfaces, the TW structure, and the TW radiator ensemble are of a canonical shape, the canonical shape comprising: a plane, a cylinder, a sphere, and a cone.

9. The unidirectional TW antenna as claimed in claim 1, wherein the TW structure is a slow-wave structure.

10. The unidirectional TW antenna as claimed in claim 9, wherein the TW antenna having a diameter less than 0.4 $\lambda_L$/SWF, wherein $\lambda_L$ is free-space wavelength at the lowest frequency of operation and SWF is a Slow Wave Factor.

* * * * *